United States Patent [19]

Moser

[11] 4,327,691

[45] May 4, 1982

[54] AIR-FUEL-MIXTURE FORMING DEVICE FOR SPARK IGNITION INTERNAL COMBUSTION ENGINES

[75] Inventor: Franz Moser, 47, Gregorygasse, Vienna, Austria

[73] Assignees: Franz Moser; Hans Peter Lenz, both of Vienna, Austria

[21] Appl. No.: 28,880

[22] Filed: Apr. 10, 1979

[30] Foreign Application Priority Data

Apr. 27, 1978 [AT] Austria ..... 3079/78

[51] Int. Cl.[3] ..... F02B 3/00

[52] U.S. Cl. ..... 123/478; 123/545; 123/179 L; 123/488

[58] Field of Search ..... 123/139 ST, 179 L, 179 G, 123/139 AW, 32 ED, 32 EA, 478, 483, 488, 491, 545; 261/DIG. 24, 23 A

[56] References Cited

U.S. PATENT DOCUMENTS

| | | | |
|---|---|---|---|
| 2,319,752 | 5/1943 | Smith | 123/545 |
| 3,125,084 | 3/1964 | Hall | 123/179 G |
| 3,628,510 | 12/1971 | Moulds | 123/179 L |
| 3,713,427 | 1/1973 | Adler | 123/32 ED |
| 3,771,505 | 11/1973 | Taplin | 123/139 AW |
| 3,971,354 | 7/1976 | Luchaco | 123/32 EA |
| 3,972,314 | 8/1976 | Dupont | 123/488 |
| 3,982,503 | 9/1976 | Keranen | 123/179 L |
| 4,034,720 | 7/1977 | Noguchi | 123/139 AW |
| 4,034,721 | 7/1977 | Lenzi | 123/139 AW |
| 4,034,733 | 7/1977 | Noguchi | 123/139 AW |
| 4,091,773 | 5/1978 | Gunda | 123/32 ED |
| 4,096,830 | 6/1978 | Long | 123/179 G |
| 4,109,616 | 8/1978 | Zechnall | 123/32 EA |
| 4,132,203 | 1/1979 | Eipern | 261/DIG. 74 |
| 4,134,368 | 1/1979 | Hadley | 123/32 EA |
| 4,157,084 | 6/1979 | Wallis | 123/179 L |

*Primary Examiner*—Charles J. Myhre
*Assistant Examiner*—Carl Stuart Miller
*Attorney, Agent, or Firm*—Watson, Cole, Grindle & Watson

[57] ABSTRACT

Internal combustion engines utilizing conventional carburetors have auxiliary devices such as a choke and accelerator pump which cause over-rich mixture and consequently affect the fuel consumption and exhaust gas emissions adversely. The present invention improves the performance of such engines whilst retaining the advantages of conventional carburetors.

The invention provides a spark ignition carburetor equipped engine with an electromagnetic injection valve disposed in the induction manifold for the supply of additional fuel when required. Actuation means for the electromagnetic injection valve are preferably electronic devices which comprise a pulse generator and measured valve transmitter (sensors) for each of the engine operating parameters relevant to the injection of additional fuel, thus the timing and duration of opening of the injection valve is controlled precisely.

11 Claims, 3 Drawing Figures

AIR-FUEL-MIXTURE FORMING DEVICE FOR SPARK IGNITION INTERNAL COMBUSTION ENGINES

BACKGROUND OF THE INVENTION

The invention relates to a device for providing an appropriate fuel mixture for internal combustion engines according to varying operating conditions. The invention is applicable to internal combustion engines of the kind comprising a carburetor, hereinafter referred to as engines of the kind defined.

DESCRIPTION OF THE PRIOR ART

The engines of motor vehicles are subjected to very widely varying conditions of operation. The need for trouble-free running of the vehicle and for low values of fuel consumption and exhaust gas emissions applies to all the operating conditions that arise. In order to take these requirements into account, in modern carburetors engines the carburetors that are used are of increasing complexity. Modern carburetors, in addition to main and idling systems, have a number of further systems which come into action under different operating conditions.

For example, for starting and the warming-up phase an auxiliary system is employed to enrich the fuel/air mixture until such time as the engine has reached its full running temperature. In most cases this is in the form of the so-called starting flap or choke which is arranged in the region of the air inlet to the carburetor and which, during starting and warm-up of the engine, reduces the full cross-section of the inlet for induction of air and, by producing an increased depression downstream of the flap, causes increased delivery of fuel through the main and idling fuel systems.

For use during acceleration, acceleration enrichment systems are employed in the form of so-called acceleration pumps which are generally coupled to the throttle linkage and with the aid of which, on operation of the accelerator pedal, an additional quantity of fuel is injected into the induction pipe during acceleration. The point of entry of the injection pipe from the accelerator pump usually lies in a zone of weak depression, i.e., at the inlet to the carburetor.

Since engines operating on the Otto cycle deliver their maximum power under air-deficient conditions, all Otto cycle engines today have the fuel/air mixture enriched in the full-load range to increase the power as compared with the part-load range, and for this purpose so-called full-load-enrichment systems are employed. These can either be depression-controlled or alternatively coupled to the throttle linkage so that their point of introduction is dependent upon the position of the throttle. To complete the picture, other auxiliary systems that should be mentioned are the by-pass system and the part-load enrichment system.

For steady operating conditions it is possible to tune the main fuel system so that the carburetor engine can operate with a weakened mixture over a large range of operation, thereby obtaining favorable fuel consumption and exhaust gas emission figures within this range. In all other cases, e.g., during starting, warming-up, acceleration and full-load, the above-mentioned auxiliary systems come into action and with their aid a corresponding enrichment of the fuel/air mixture is provided to ensure the continued good performance of the motor vehicle. A serious disadvantage is that always, when these additional systems come into action, the value of the fuel consumption figures and the exhaust gas emission are to some extent adversely affected.

In carburetor engines in which several cylinders are fed from only one carburetor, the distribution of the fuel/air mixture delivered by the carburetor to the individual cylinders is frequently uneven and this uneven distribution, according to the operating conditions, in particular also on account of the varying position of the throttle in the carburetor and altering with variations in throttle position, can vary very widely. This is the case in particular during warming-up. In order to avoid, for example, the possibility of the cylinder with the weakest mixture misfiring during warming-up or acceleration, the appropriate auxiliary system of the carburetor must be brought into action so that even that cylinder which has the weakest mixture must still have a sufficient safety margin above the misfire threshold. However, this means that the remaining cylinders must run with a unnecessarily rich mixture, and to this can be attributed a substantial proportion of the excessive values of the fuel consumption and exhaust gas emissions, in particular carbon monoxide and unburnt hydrocarbons.

The numerous auxiliary systems not only continually increase the cost of the carburetor, due to sharp increases in the manufacturing and assembly costs and also to the cost of servicing, but also result in increased risks of mechanical breakdowns. Adjustment of the stated auxiliary systems can only be carried out by specially trained personnel and in many cases only by the manufacturer himself. Finally, as the auxiliary systems involve mechanically moving components, which are also subjected to wear, the maintenance of the exact adjustment of the auxiliary systems over a long period of time presents difficulties.

Some of the above-mentioned drawbacks in Otto cycle engines can be overcome by employing fuel injection systems, for example, electronically-controlling induction manifold injection systems, instead of carburetors. Such mixture-forming systems have, however, the substantial drawback of being much more expensive than even the most expensive forms of carburetors. Furthermore, in the event of failure of an electronic component in the electronic control the vehicle is put completely out of action. A rapid repair can generally only be achieved by complete replacement of the electronics as the location of the fault is possible only in the manufacturer's works or in special workshops. This very significant drawback has meant that, despite the recognised advantages of electronic manifold injection, many users have turned away again from such systems.

SUMMARY OF THE INVENTION

The aim of the invention is to provide a device for forming an appropriate fuel mixture for internal combustion engines in which the above-mentioned drawbacks of known engines fitted with carburetors or with electronic injection systems are avoided and which is distinguished by simple and easily monitored construction with ease of repair and economical manufacture and maintenance.

The present invention consists in a device for providing an appropriate fuel mixture for internal combustion engines according to varying operating conditions, the device comprising a carburetor and an injection valve adapted to be disposed in the induction pipe and connected to the fuel system of the engine, the injection valve being actuated electromagnetically in order to deliver into the induction pipe additional fuel over and above the quantity delivered by the carburetor in accordance with at least one operating parameter of the engine.

Preferably, the injection valve should be disposed in the induction pipe upstream of any branch pipes to the cylinders.

With this arrangement a very simple carburetor can be used with advantage, without expensive auxiliary systems and with only a few mechanically moving parts, and the carburetor can be tuned to produce a very weak mixture so that under steady operating conditions the advantages of favorable fuel consumption and exhaust gas emission characteristics are obtained. The necessary enrichment of the fuel/air mixture for the starting, warming-up and acceleration phases and for full-load operation is obtained through the electromagnetic injection valve, the control of which is substantially simpler than the control of an electronic induction manifold injection system. The question of a vehicle equipped in accordance with the invention being put out of action as a consequence of failure of an electronic component can no longer arise as the simple carburetor allows at least restricted continued running of the vehicle.

According to a further feature of the invention it is provided that the electromagnetic injection valve is arranged downstream of the throttle valve of the carburetor, looking in the direction of air flow. This has been found to be unexpectedly advantageous in a particularly critical operating condition, namely during acceleration of the engine shortly after starting. In conventional carburetor engines, good acceleration characteristics when the engine is cold can only be achieved, despite the provision of the usual acceleration pump, if, in addition a sufficient fuel-rich mixture is made available by means of the choke. However, this has the drawback, already stated, of causing high fuel consumption and high carbon monoxide and hydrocarbon emissions. If, in order to avoid this, the degree of enrichment on warming-up is sharply reduced, then even with an increase in the quantity of fuel injected through the acceleration enrichment systems, satisfactory accelerating behavior cannot be obtained.

With the aid of the introduction of fuel in the manner according to the invention, through the electromagnetic injection valve arranged downstream of the carburetor throttle, unexpectedly, it has been found that, with a substantially reduced degree of enrichment during warming-up, acceleration characteristics can be obtained as good as those with acceleration processes employing the usual marked enrichment during warming-up. Good acceleration characteristics of the cold engine are thereby achieved yet accompanied by significantly reduced fuel consumption and exhaust gas emission valves. By the placing of the electromagnetic injection valve downstream of the carburetor throttle valve, there is no obstruction in the way of the fuel emerging from the injection nozzle of the electromagnetic injection valve, such as is the case when the fuel is introduced through the usual injection pipe of the acceleration pump which is arranged at the entrance to the carburetor, upstream of the throttle valve. In the latter case the stream of fuel emerging from the injection pipes impinges initially on the cold carburetor throttle valve which, on starting, may be as low as −15° C. in low outside temperatures, preventing the evaporation of the fuel necessary to achieve good acceleration characteristics.

In multi-carburetor engines it is of advantage if an electromagnetic injection valve is provided in the induction system for each carburetor so that equally good relationships are present for the individual groups of cylinders. Furthermore, in engines having an induction system with a heated portion it is of advantage if the injection valve is arranged upstream of the hot spot, looking in the direction of the flow of the air, and in particular, if the injection valve is arranged in the immediate neighborhood of the hot spot further improved performance is achieved, especially during the warming-up phase.

According to a further feature of the invention it has been found to be advantageous if the electromagnetic injection valve is permanently connected to the fuel pump for the carburetor. As the fuel pump for feeding the carburetor has to be present anyway, the feed to the electromagnetic injection valve consequently requires no further engineering steps involving increased cost. Moreover, it has been found that, during acceleration, a particular further advantage of this arrangement is an automatic matching of the quantity of fuel reaching the induction pipe through the electromagnetic injection valve. In the idling range and the lower part-load range there is a high prevailing depression in the induction system by virtue of the throttle valve of the carburetor being almost closed, so that when the electromagnetic injection valve is brought into action on acceleration, i.e. on operation of the throttle, at first by virtue of the relatively high pressure difference at the injection valve a large quantity of fuel is introduced into the induction system and also consumed. With increasing opening of the throttle, the depression in the induction system falls and so also does the pressure difference at the electromagnetic injection valve and thereby the quantity of fuel delivered is smaller. Therefore at the start of the acceleration process a sufficient quantity of fuel is available and it is continuously reduced as the acceleration proceeds. As the additional injection of fuel takes place practically without delay, a very good acceleration behavior is obtained and, by virture of the above-mentioned flow characteristics at the electromagnetic injection valve, there is a significantly lower emission of carbon monoxide and hydrocarbons. In conventional carburetor enrichment systems, by contrast, the unavoidable lost motion in the linkage of the mechanism of the acceleration pump means that the injection can only take place after a delay and because the injection pipe is at the entry side of the carburetor the injection is hindered by the presence of the throttle valve.

According to a further feature of the invention it can also be arranged that a pressure regulator, acted on by the depression in the induction system of the engine, is introduced between the fuel pump and the electromagnetic injection valve to maintain constant the pressure difference at the injection valve. This can be found to be of advantage in many cases, for example where the additional injection is used for full-load enrichment.

According to a further feature of the invention a pulse generator is provided for controlling the elctromagnetic injection valve and a measured value transmitter is provided for at least one engine operating parameter of significance to the additional injection process, the transmitter producing an electrical signal corresponding to the particular engine operating parameter, and between the pulse generator and the injection valve there is arranged an electronic pulse shaper for each measured value transmitter, to which also the signal from the assiciated measured value transmitter is fed and which alters the shape and duration of the pulse, delivered from the pulse generator, and thereby alters the duration of opening of the electromagnetic injection valve in accordance with the respective measured value transmitter signal.

In this way a flexible control of the additional quantity of fuel is achieved, and the measured value transmitter and the pulse shaper enable matching of the additional fuel required to the prevailing operating conditions of the engine to be achieved in a simple manner. Since a separate pulse shaper is present for each of the cases that arise calling for additional fuel injection, all the additional functions can be easily supervised and in the event of failure of one of them the remainder are unaffected. Also, it is significantly easier to locate a fault in the electronics for the electromagnetic injection alve than in an electronic induction manifold injection system. If the electronics necessary for the various additional functions are mounted each for example on its own plug-in circuit board, repair can be performed in a simple manner at low cost and in a short time by simply replacing the board in question.

In a development of the invention it is of advantage, in particular in the case of a mixture-forming device with several measured value transmitters and pulse shapers, if the signals produced by the pulse shapers are fed to an evaluating circuit connected ahead of the electromagnetic injection valve and if the incoming signals are combined in this evaluating circuit in accordance with a predetermined law. Accordingly, the resulting signal, i.e., the duration of the pulse fed to the electromagnetic injection valve, can be influenced in a desired manner. A particularly simple construction is achieved if the evaluating circuit is an adder in which the signals are simply added together.

In a further development of the invention it can be provided that the pulses for controlling the electromagnetic injection valve are in the form of pulses from the ignition equipment of the engine. In such a case the pulses can be picked up preferably by means of an inductive pick-up arranged on the secondary side of the ignition coil. As the spark timing of an engine is matched to the varying operating conditions, and generally in particular to varying speeds and loads, the use of the pulses from the ignition system simultaneously also corrects the instant of opening of the electromagnetic injection valve for the addition of extra fuel in accordance with speed and load. Thus the initiation of the additional injection ideally occurs, for example, in a four-cylinder engine, at about the beginning of the induction stroke in one of the four cylinders. As a consequence of the correction of the ignition timing, by which for example the timing is advanced with increasing speed, there is also the advantage that with increasing speed the time available for the fuel introduced through the electromagnetic injection valve to mix with the air is extended. From this there is obtained on the one hand good mixing of the additional fuel throughout the operating range and on the other hand a very rapid response of the engine to this additional quantity of fuel.

DESCRIPTION OF THE DRAWINGS

The invention is further explained now in conjunction with an embodiment by way of example.

In the drawings.

DESCRIPTION OF THE PREFERRED EMBODIMENT

Figures 1, 1A:
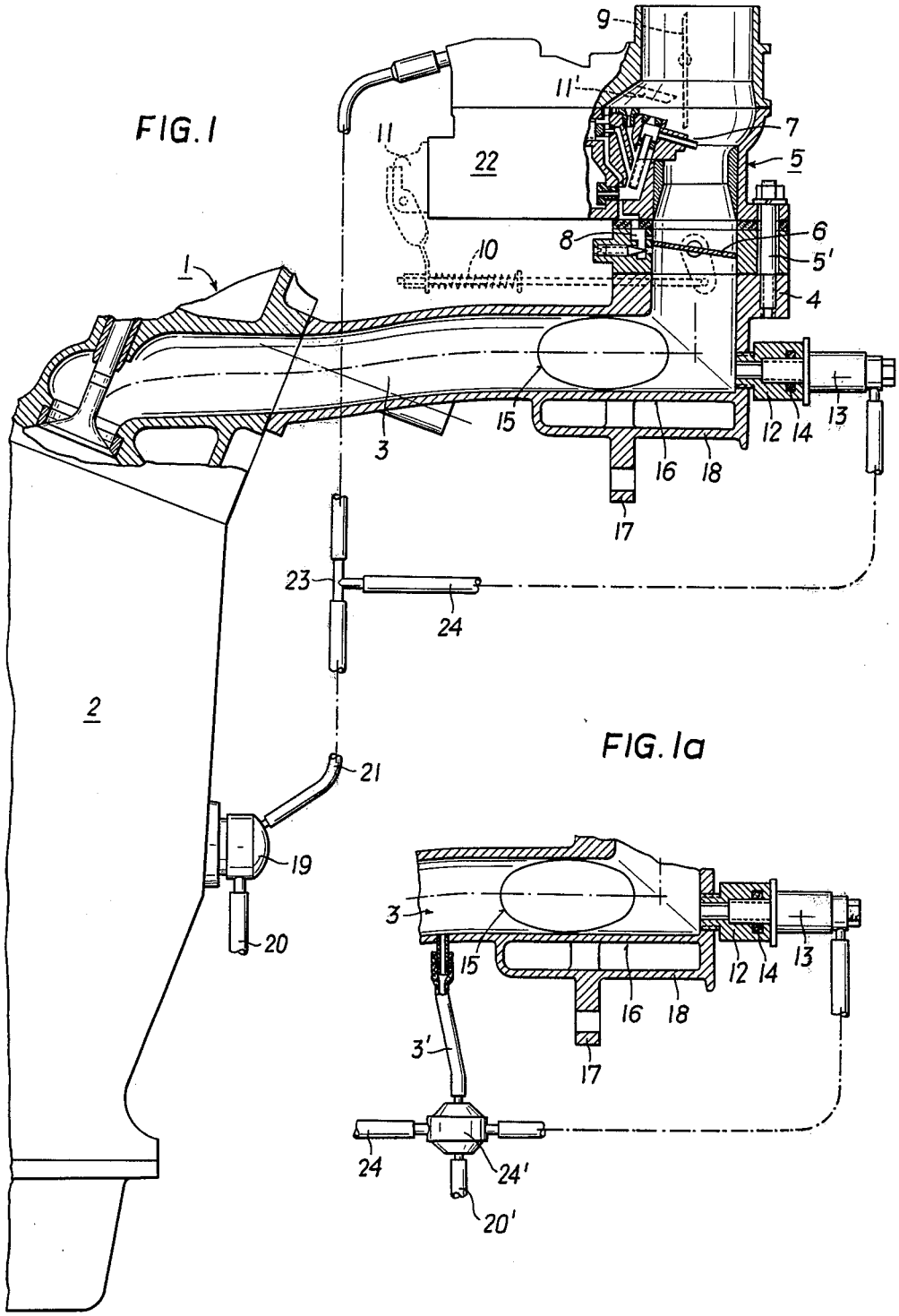
FIG. 1 shows a sectional view through a portion of an internal combustion engine, shown diagrammatically, which is provided with an embodiment of mixture-forming device according to the invention.
FIG. 1*a* shows a detail of a modified embodiment of mixture-forming device shown in FIG. 1.

As can be seen from a review of FIG. 1, mounted on the cylinder head 1 of the engine 2 is an induction manifold 3, and secured to the inlet flange 4 of the induction manifold 3 is by means of screw fixings 5' is a carburetor 5. The carburetor 5, shown partly in section, includes a throttle valve 6, a main fuel system 7 and an idling system 8. The other additional systems which would otherwise be present in conventional carburetor engines, namely the starting flap or choke 9 and the acceleration enrichment system comprising the pump rod 10, the acceleration pump 11 and the injection pipe 11', are shown in broken lines as, by virtue of the invention, they can be omitted.

Provided in the induction manifold 3 below the inlet flange 4 there is a bore to receive a screw-in adapter 12 in which is inserted an electromagnetic injection valve 13 of known construction, sealed by means of the O-ring 14.

In the region of the induction manifold where the fuel changes flow directions so as to branch into individual arms, this region being indicated by the intersecting lines 15, the induction manifold 3 includes a portion 16 which is heated by the engine cooling water, this being the so-called hot spot. Thus the injection of additional fuel takes place in the immediate neighborhood of that region of the induction manifold which is most rapidly heated up following starting. The projecting portion 17 on the lower wall 18 of the hot spot is nothing to do with the invention and only serves for supporting the induction manifold.

A mechanically driven fuel pump 19 is mounted on a flange on the engine 2 and has its suction side connected to the fuel tank of the vehicle (not shown) through a pipe 20. A pipe 21 leads from the delivery side of the pump to the float chamber 22 of the carburetor 5. A Tee-piece 23 is inserted in this pipe 21 and allows the injection valve 13 to be supplied with fuel in parallel with the carburetor 5 through the pipe 24. As the usual fuel pumps of the diaphragm type only produce a pressure of around 100 mm. of mercury in the fuel system, the injection of the fuel through the injection valve 13 is dependent largely on the depression that exists in the induction manifold 3. In the idling range and the lower part-load of engine operations there is a high depression in the manifold because the throttle valve is only slightly open under these conditions. With increasing opening of the throttle, i.e. with rising load, the depression in the manifold falls. From this it follows that, for example, in acceleration from idling there is advantageously an automatic regulation of the delivery of fuel from the injection valve 13, since due to the initial high depression in the manifold a relatively large quantity of fuel flows through the valve whereas with increasing opening of the throttle a progressively smaller quantity of fuel flows.

It is also possible to provide an electrically driven fuel pump with a corresponding return flow connection in order to achieve higher pressures upstream of the injection valve 13 if required. Mainly in this case, but also where the mechanically driven fuel pump is employed, it may be advantageous to provide a pressure regulator 24' between the pump and the injection valve 13, acted on through a pipe 3' by the depression prevailing in the manifold 3, and a return pipe 20' for part of the fuel. This alternative is illustrated in FIG. 1*a*. It is thus possible to maintain constant the pressure difference at the injection valve 13 which determines the quantity of fuel delivered in unit time so that, independently of the depression prevailing in the manifold 3, the flow through the injection valve 13 is constant and is therefore a function only of the duration of time for which the valve is open.

Figure 2:
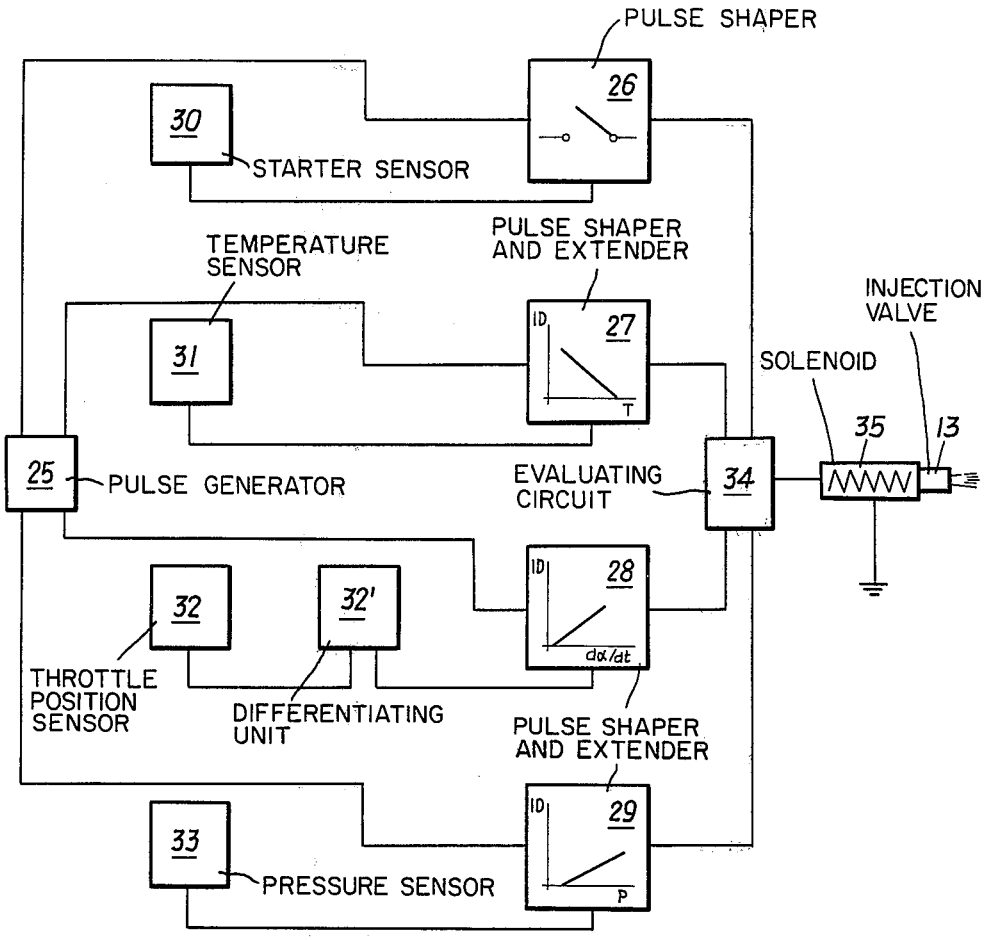
FIG. 2 shows a block circuit diagram of the associated control system for the mixture-forming device of FIG. 1.

FIG. 2 is a block circuit diagram for the electronics for controlling the injection valve 13. The pulse generator 25 can be of a known kind and it serves to trigger the injection valve 13. It is convenient to slip a simple inductive pulse generator over the high tension cable leading from the ignition coil, not shown, as this enables correctly timed pulses to be produced in a very simple manner.

The pulse generator 25 is connected electrically to a number of pulse shapers 26 to 29. Measured value transmitters 30 to 33 are provided on the engine 2, each of which ascertains an engine operating parameter which is of significance for the auxiliary fuel injection. An electrical signal corresponding to the parameter in question is fed to the associated pulse shaper.

Each pulse shaper converts the pulses delivered by the pulse generator 25 into a predetermined form, for example into a rectangular pulse, and varies the duration of this modified pulse in accordance with the electrical signal coming from the associated measured value transmitter, according to a predetermined relationship. The relationship between the respective engine operating condition and the duration of the pulse is ascertained, for example, by experiment. The derivation of such functions is possible by means of simple analogue computing circuits.

The correspondingly shaped pulses are fed to an evaluating circuit 34, in which either a simple superposition of the incoming signals from the pulse shapers 26 to 29 takes place or in which it is also possible for them to be combined according to a predetermined law. An amplifier stage is preferably incorporated into the evaluating circuit 34 and it amplifies the resulting signal, which is a pulse of predetermined duration. This finally shaped signal is fed to the solenoid 35 of the injection valve 13. This opens for the duration of the incoming pulse, and allows injection of additional fuel.

In detail the following engine operated parameters are used for controlling the additional injection in the example shown in FIG. 2: the starting process, for which the starter switch indicated at 30 serves as the "measured value transmitter"; a characteristic engine operating temperature, for example the temperature of the coolant, which is ascertained by the temperature sensor 31; the position of the throttle valve which, in the simplest form, can be derived by means of a rotary potentiometer mounted on the throttle spindle to form a throttle valve setting transmitter 32; the induction manifold depression by means of the pressure sensor 33 which can also be formed as a sensor for sensing the absolute pressure, thus taking into account the pressure of the surrounding atmosphere.

When the engine is started, turning of the ignition key in the ignition switch 30 closes the starter circuit and also activates the pulse shaper 26. The pulses coming from the generator 25 are shaped and emerge from the shaper 26 as long as the starting continues, with a constant duration so that during the entire starting process a predetermined quantity of fuel is introduced through the injection valve 13. When the engine starts running the starter circuit is broken and the pulse shaper 26 is cut off. Accordingly, this arrangement also fulfills part of the function of the starting flap or choke 9 necessary in conventional carburetors.

The temperature sensor 31 delivers to the pulse shaper 27 a signal depending on the temperature of the engine, this shaper also receiving pulses from the generator 25. In accordance with the given function, the pulse shaper 27 shapes and extends the incoming pulses at low temperatures and shortens them with rising temperature. When the engine reaches its operating temperature, the pulse duration falls to zero, and so there is no further additional injection. This arrangement fulfills the second function of the starting choke, namely, enrichment of the fuel/air mixture during the warming-up phase.

The throttle valve position transmitter 32 signals the position of the throttle 6. When the throttle 6 is at an angular position $\alpha$ it feeds a corresponding electrical signal to the differentiating circuit 32' that follows it and in this circuit the derivative of the angular position of the throttle with respect to time, $d\alpha/dt$ is formed. An electrical signal corresponding to the value $d\alpha/dt$ is fed to the pulse shaper 28 which now shapes the pulses supplied from the pulse generator 25 and varies their duration in accordance with the value $d\alpha/dt$. In constant running, i.e., when the throttle valve is stationary, or on deceleration, $d\alpha/dt$ is zero or negative and the pulse shaper 28 delivers no pulses and so there is no injection of additional fuel. With positive values of $d\alpha/dt$ the duration of the pulses changes in accordance with the predetermined relationship and so additional fuel is injected according to the acceleration. This device replaces the acceleration pump 11 with its linkage 10 and its injection pipe 11', and the additional fuel passages, not shown, necessary in the carburetor in the case of conventional carburetors.

The load on the engine is ascertained by the pressure sensor 33 which feeds corresponding electrical signals to the pulse shaper 29 which again shapes, according to the predetermined relationship, the pulses fed from the generator 25 so that, for example, under full load conditions additional fuel is injected through the injection valve 13. This device replaces the conventional part-load and full-load enrichment system controlled by depression or coupled mechanically to the throttle valve.

It will be understood that it is possible to take account of fewer or of still further engine operating conditions to control the injection of additional fuel. The most important have been found to be the acceleration enrichment 32, 32', 28 and the warming-up phase enrichment 31, 27 and above all, in the particularly critical warming-up phase, an unexpectedly good acceleration behavior can be achieved with low emission peaks as the injection takes place practically without delay and corrected to be independent of temperature.

It is also possible, for example, to replace the idling system either wholly or partially by additional injection. In this case the position of the throttle valve 6 is ascertained by means of the throttle sensor 32 and fed to a further pulse shaper, not shown, which feeds pulses of constant duration to the evaluating circuit 34 when the throttle valve is in its closed position.

The evaluating circuit 34 can also be omitted if each pulse shaper 26 to 29 has its own operational amplifier associated with it and there is no special manner of combination of the pulses fed from the pulse shapers to the injection valve 13. Then each pulse shaper 26 to 29 is connected directly to the solenoid 35 of the injection valve 13. In this case the entire electronics of each auxiliary system can be mounted on their own plug-in circuit board so that, apart from the common pulse generator, the various auxiliary systems are completely independent. Location of faults and elimination of them in the eletronics system is thereby very much simplified as only the board in question needs to be replaced.

It will be appreciated that although the preferred embodiment hereinbefore described in applicable to four-stroke engines only, there is no reason why the invention should not be applied to two-stroke engines comprising one or more carburetors.

We claim:

1. In a multi-cylinder internal combustion engine which includes a carburetor, a fuel pump, first pipe means for supplying fuel from said fuel pump to said carburetor, and an induction manifold, including branch pipes, connected between the carburetor and the cylinders in the engine for delivering fuel thereto, said carburetor including a throttle valve and said induction pipe including a portion between the carburetor and the branch pipes which includes means for heating the inside of said induction pipe to create a hot spot, the improvement wherein an electromagnetic fuel injection valve is connected to said induction manifold between said carburetor and said branch pipes, a second pipe means is connected between said first pipe means and said fuel injection valve for supplying fuel to said fuel injection valve, and an electrical control means is connected to said electromagnetic fuel injection valve for causing said valve to inject fuel into said induction manifold based on at least one operating parameter of said engine, said electrical control means including a pulse generator, at least one sensor element attached to the engine so as to sense a different operating parameter, and a separate electrical pulse modifier means connected with each sensor element, each said electrical pulse modifier means also being connected to said pulse generator to receive a pulse therefrom, and each said electrical pulse modifier means operating to provide a pulse capable of controlling the operation of said fuel injection valve based on signals received from the associated sensor element.

2. The internal combustion engine as claimed in claim 1 wherein said electromagnetic fuel injection valve is connected to said induction manifold adjacent the location where said chamber is formed therearound, such that the fuel injected into said induction manifold by said fuel injection valve will be heated by "hot spot."

3. The internal combustion engine as claimed in claim 1 wherein said second pipe means includes a pressure regulator therein, and wherein said pressure regulator includes a pipe connected to said induction manifold to detect the pressure therein, the pressure regulator functioning to maintain a constant pressure difference between that in said fuel injection valve and that measured in said induction manifold.

4. The internal combustion engine as claimed in claim 1 wherein said electrical control means includes a multiplicity of sensor elements and associated electrical pulse modifier means, and wherein said electrical control means includes an evaluating circuit means, the pulses from each of said electrical pulse modifier means being fed to said evaluating circuit means where they are combined in a suitable fashion to produce a control signal, this control signal then being sent to said fuel injection valve for operating same.

5. The internal combustion engine as claimed in claim 4 wherein said evaluating circuit means acts to add together the pulses from the electrical pulse modifier means.

6. The internal combustion engine as claimed in claim 4 wherein said engine includes ignition equipment including an ignition coil, and wherein said ignition coil functions as said pulse generator.

7. The internal combustion engine as claimed in claim 6 wherein said ignition coil sends pulses to said electrical pulse modifier means by electrical lines which include an inductive pick-up means located on the secondary side of the ignition coil.

8. The internal combustion engine as claimed in claim 1 wherein said engine includes a multiplicity of carburetors and a multiplicity of associated induction manifolds, and wherein an electromagnetic fuel injection valve is provided in each induction manifold.

9. The internal combustion engine as claimed in claim 1 wherein one sensor element is a temperature sensor capable of measuring the temperature of the engine coolant, one sensor element is a throttle sensor capable of measuring the opening of the throttle valve, one sensor element is a pressure sensor capable of measuring the relative pressure in the induction manifold, and one sensor element is a starter sensor capable of detecting the initial start up of the engine.

10. The internal combustion engine as claimed in claim 9 wherein the electrical pulse modifier means associated with each of said temperature sensor, said throttle sensor, and said pressure sensor are capable of shaping and extending the pulse supplied thereto from the pulse generator, whereas the electrical pulse modifier means associated with said starter sensor is capable only of shaping the pulse supplied thereto from the pulse generator.

11. The internal combustion engine as claimed in claim 1 wherein said means forming said hot spot includes a chamber positioned around the outside of said induction pipe through which hot engine coolant flows.

* * * * *